US008147101B2

(12) United States Patent
Tu et al.

(10) Patent No.: US 8,147,101 B2
(45) Date of Patent: Apr. 3, 2012

(54) LED LAMP AND HEAT-DISSIPATING WATERPROOF COVER THEREOF

(75) Inventors: Shang Te Tu, Hsinchu (TW); Yen Chu Teng, Hsinchu County (TW); Chia Chen Chang, Yilan County (TW); Wei Hung Wu, Kaohsiung (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 443 days.

(21) Appl. No.: 12/546,081

(22) Filed: Aug. 24, 2009

(65) Prior Publication Data

US 2010/0053966 A1 Mar. 4, 2010

(30) Foreign Application Priority Data

Aug. 28, 2008 (TW) ..... 97132871 A

(51) Int. Cl.
*F21V 29/00* (2006.01)
*F21S 4/00* (2006.01)

(52) U.S. Cl. ..... 362/373; 362/294; 362/249.02; 362/253; 362/234

(58) Field of Classification Search ..... 362/249.01–249.06, 294, 373, 362/253, 345, 234, 362, 431, 218, 264, 800
See application file for complete search history.

(56) References Cited

U.S. PATENT DOCUMENTS 7,762,690 B2 * 7/2010 Li et al. ..... 362/294
7,878,691 B2 * 2/2011 Liang ..... 362/373
7,922,372 B2 * 4/2011 Li ..... 362/373

* cited by examiner

*Primary Examiner* — Bao Q Truong
(74) *Attorney, Agent, or Firm* — Altis Law Group, Inc.

(57) ABSTRACT

An LED lamp includes an illumination apparatus and a heat-dissipating waterproof cover. The illumination apparatus includes LED modules; and the heat-dissipating waterproof cover is configured to cover the LED modules. The heat-dissipating waterproof cover includes a plurality of drain members, and a gap is formed between every two drain members so as to increase the air convection, thereby increasing heat dissipation efficiency of the LED modules. Every two adjacent drain members are partially overlapping in vertical to prevent the intrusion of water.

20 Claims, 7 Drawing Sheets

LED LAMP AND HEAT-DISSIPATING WATERPROOF COVER THEREOF

BACKGROUND OF THE INVENTION (A) Field of the Invention

The present invention relates to a light emitting diode (LED) lamp, and more particularly, to an LED lamp and heat-dissipating waterproof cover thereof with heat-dissipating and waterproofing functions.

(B) Description of the Related Art

In recent years, LEDs have demonstrated advantages of small size, low power consumption, long life, and endurance of vibration, and have been increasingly applied to various display applications. Due to recent increases in oil prices, LEDs with superior power saving efficiency may replace traditional lamps for illumination.

In comparison with incandescent lamps, LEDs can reduce power consumption by more than 40%. Thus, LEDs are being introduced in various illumination fields as part of power-saving plans in every country.

However, the high-power LED illumination lamp generates large amounts of heat. If the heat cannot dissipate efficiently, the efficiency and the lifetime of LEDs is limited.

Current LED illumination technology has some limitations, including: (1) the lamp cannot provide a heat dissipating path for hot air passing through the lamp from bottom to top; (2) the waterproof cover of the lamp overlies the entire lamp, so that the heat exchange with cool air only occurs at the sides of the lamp, which is not advantageous to heat convection with vertical exchange behavior; (3) because of poor heat dissipation, heat accumulates at the center of the lamp more than at the edges; (4) the lamp does not provide function of drain and guidance of flow; (5) any increase in the size of the heat dissipating holes at sides of the lamp would increase heat dissipating efficiency, but would decrease the waterproofing and rainproofing capability; (6) a waterproof mechanism has to be combined with heat process, inducing high cost and lack of flexibility; (7) the heat dissipating efficiency of the horizontal fins of the lamp is not good; and (8) the heat dissipating fins enclosed by the waterproof cover cannot perform convection with external cool air.

To maintain the heat-dissipating and waterproofing functions of the LED lamps at the same time is a difficult problem, and a breakthrough is needed to address both issues effectively.

SUMMARY OF THE INVENTION

The present invention provides an LED lamp and the heat dissipating waterproof cover thereof, which have superior rainproof, waterproof and heat convection mechanisms, and can meet heat dissipating and waterproof requirements at the same time.

The LED lamp includes an illumination apparatus and a heat-dissipating waterproof cover. The illumination apparatus includes LED modules, and the heat-dissipating waterproof cover is configured to cover the LED modules. The heat-dissipating waterproof cover includes a plurality of first drain members, and a first gap is formed between every two adjacent first drain members, so as to increase the heat-dissipating efficiency of the LED modules by air convection. Every two adjacent first drain members are partially overlapping in vertical to prevent the intrusion of water.

In an embodiment, the first drain member comprises a drain surface and a groove connected to a side of the drain surface, and the drain surface is inclined toward the groove for guiding water on the drain surface into the groove.

In another embodiment, the heat-dissipating waterproof cover further comprises a second drain member, and the second drain member is associated with the first drain member to cover the LED module. The second drain member is disposed at the center of the heat-dissipating waterproof cover, and the first drain members are symmetrically disposed at either side of the second drain member. The drain surfaces of the first drain members are inclined toward the second drain member.

The LED lamp and the heat-dissipating waterproof cover provide not only air convection channels for increasing heat-dissipating efficiency of LED modules, but also a waterproof mechanism. Therefore, only the electrical body needs to be sealed or given anti-moisture treatment, so that the LED lamp can endure exposure to outdoor weather or rain.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

The present invention relates to a light module. To clearly understand the present invention, the detailed device structure is discussed below. The implementation of the present invention is not restricted to that known by the people skilled in the art. Moreover, known devices may not be described below to avoid unnecessary limitations. The preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1A:
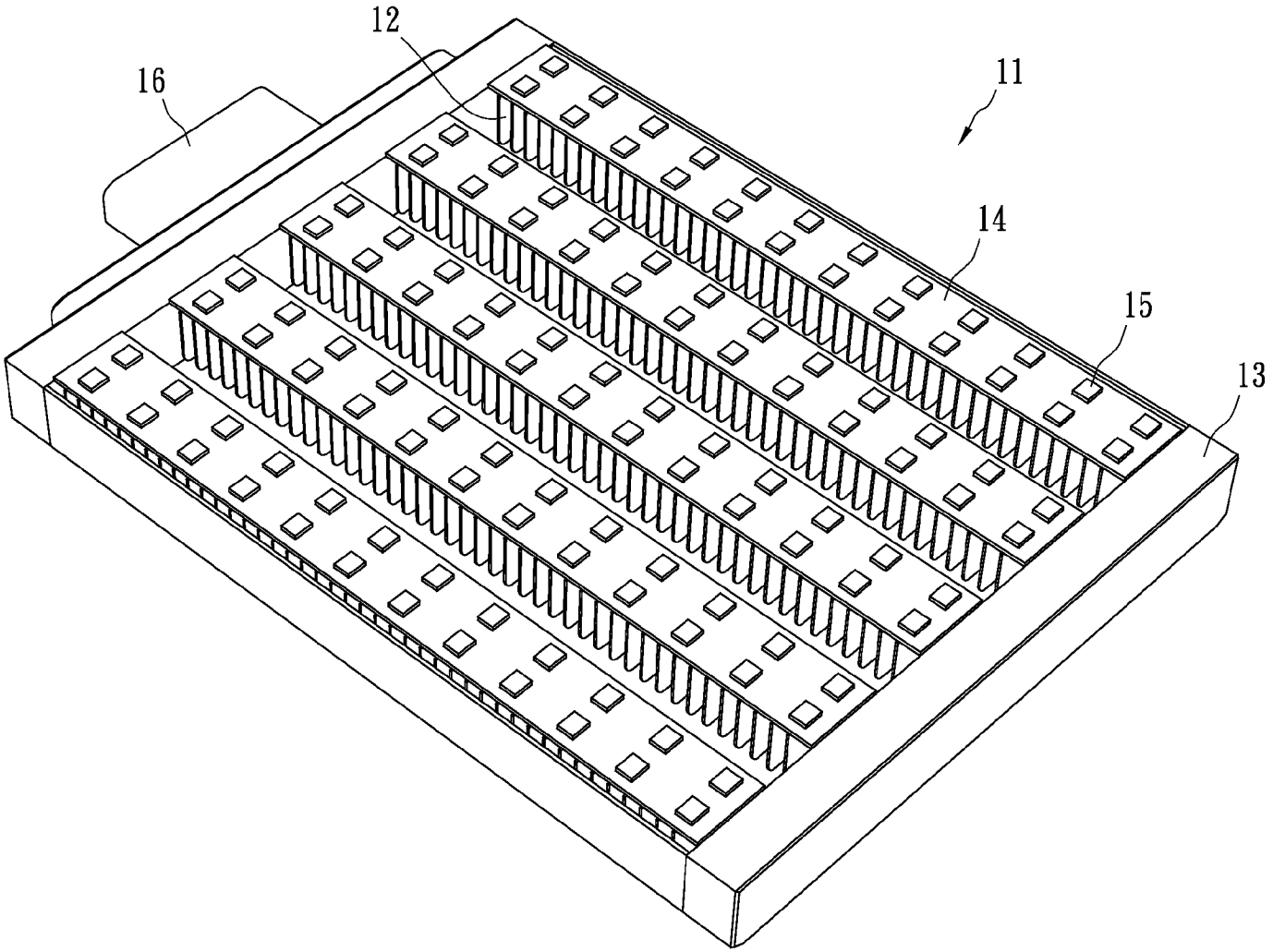
FIGS. 1A and 1B illustrate an illumination apparatus of an LED lamp in accordance with the present invention.
Figure 1B:
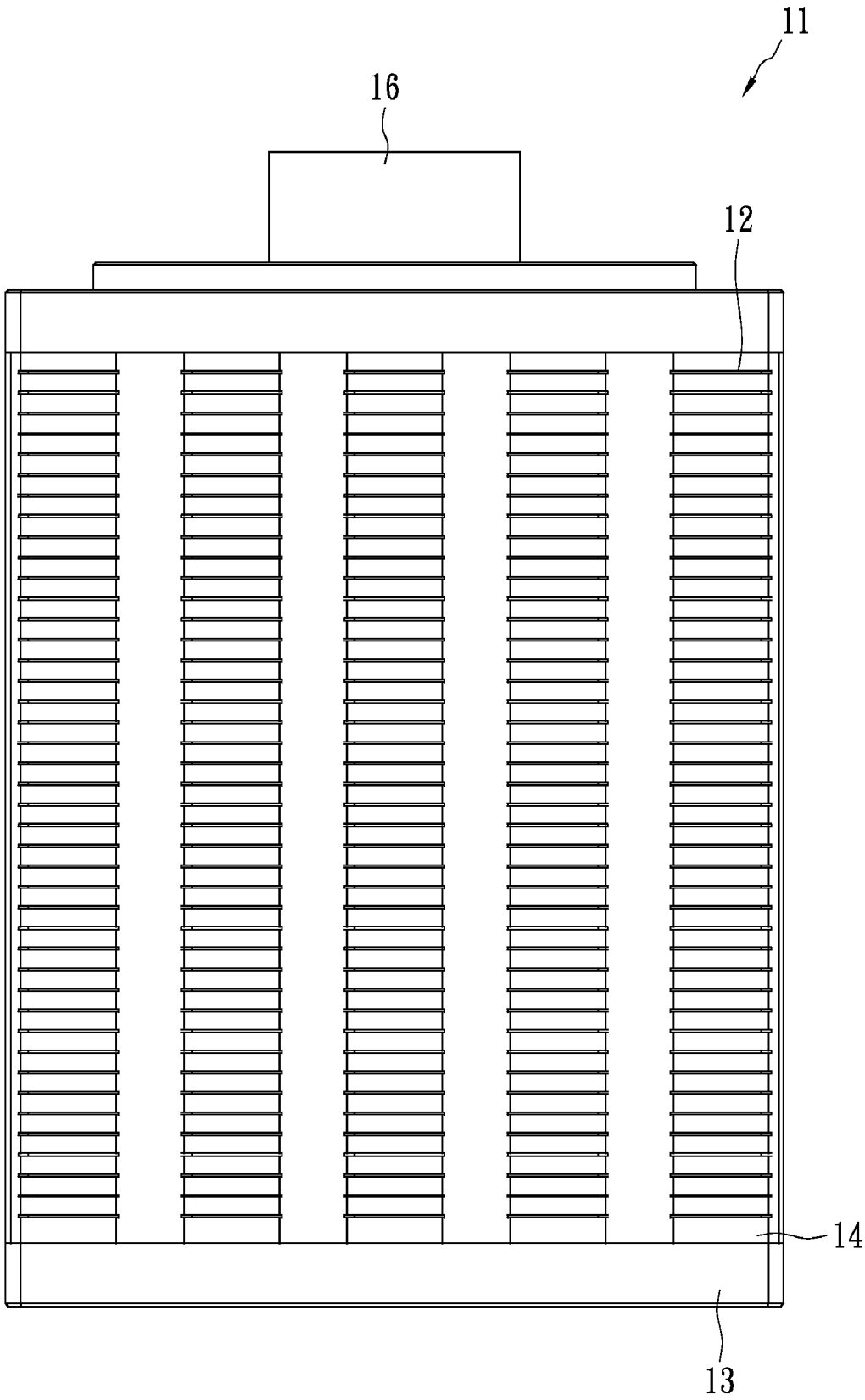

FIGS. 1A and 1B illustrate an illumination apparatus 11, and FIG. 1B is the top view of the back of the illumination apparatus 11 shown in FIG. 1A. A plurality of strip-like LED modules 14 (five modules in this embodiment) are disposed on the housing 13 (see FIG. 1A), and a plurality of LED devices 15 are formed on each LED module 14 for illumination. A plurality of fins 12 are formed on the side of the LED module 14 opposite to the side having the LED device 15. The fins 12 are formed in the housing 13 for dissipating the heat generated by the LED devices 15. In this embodiment, the fins 12 are plate-like and disposed along the longitudinal direction of the LED module 14 one by one, and each fin extends laterally on the LED module 14. A side of the housing 13 is provided with a connector 16 for being connected to a support and a power source.

An ordinary outdoor lamp usually emits light downwards, such that a rainproof cover would be formed above the housing 13. However, the rainproof cover would encapsulate the fins 12 in the housing 13; and although the fins 12 may be not completely sealed, the heat still cannot be dissipated efficiently. Therefore, the illumination efficiency of the LED device 15 is impacted and the lifetime of the LED device 15 is decreased.

In accordance with the present invention, a heat-dissipating waterproof cover is formed on the illumination apparatus 11 to provide efficient heat convection for increased heat-dissipating efficiency. The cover has waterproof and drain functions, and therefore it can be applied for outdoor illumination.

Figure 2A:
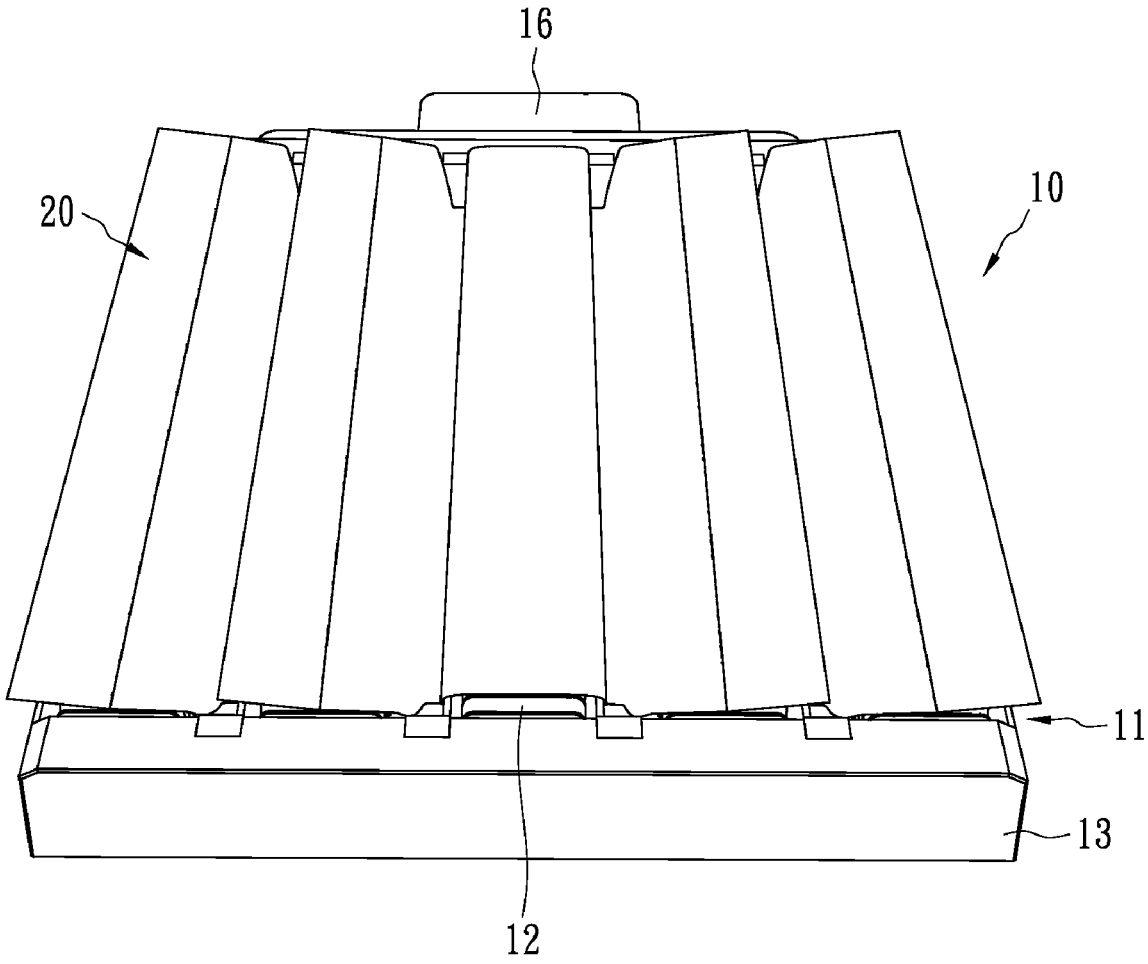
FIGS. 2A, 2B and 2C illustrate an LED lamp in accordance with an embodiment of the present invention.

FIG. 2A illuminates an LED lamp 10 including the illumination apparatus 11 shown in FIG. 1 and a heat-dissipating waterproof cover 20. The heat-dissipating waterproof cover 20 is formed above the illumination apparatus 11.

Figure 2B:
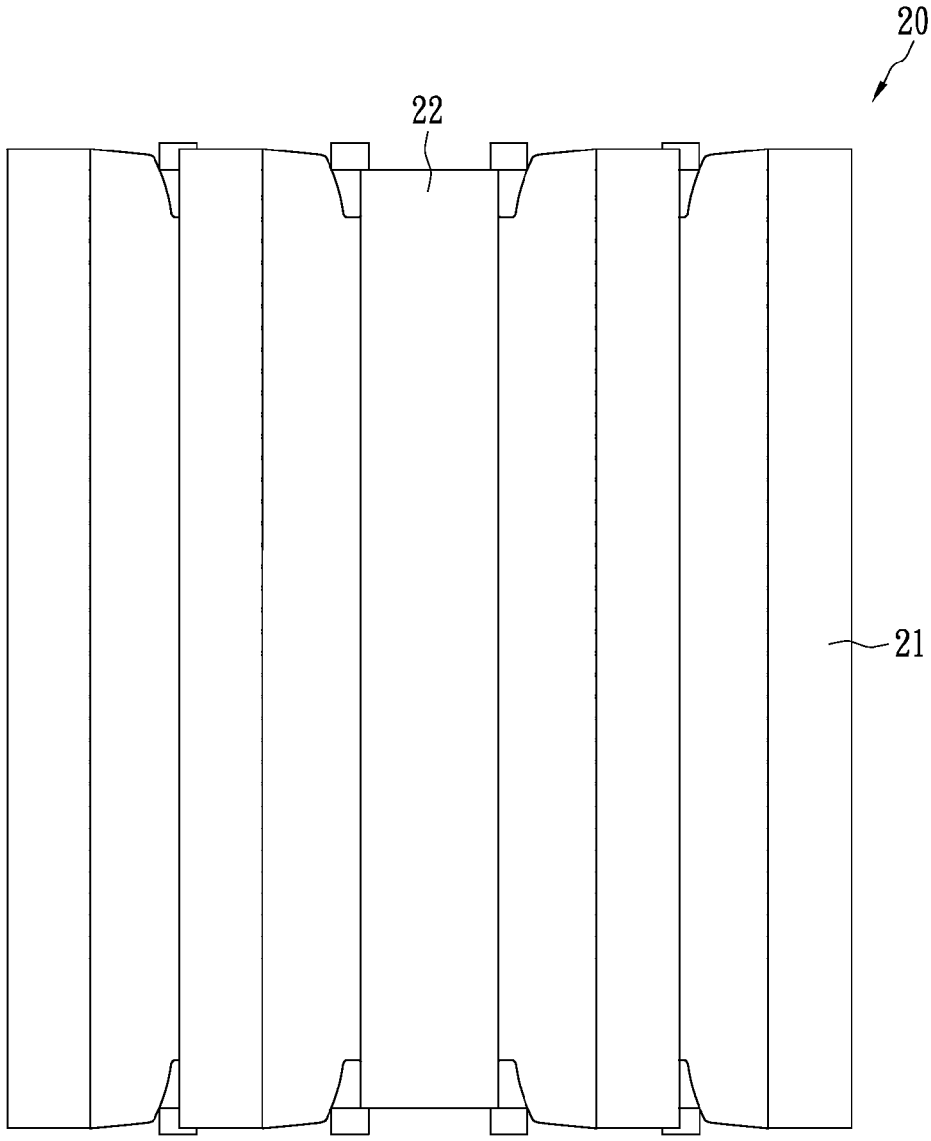
Figure 2C:
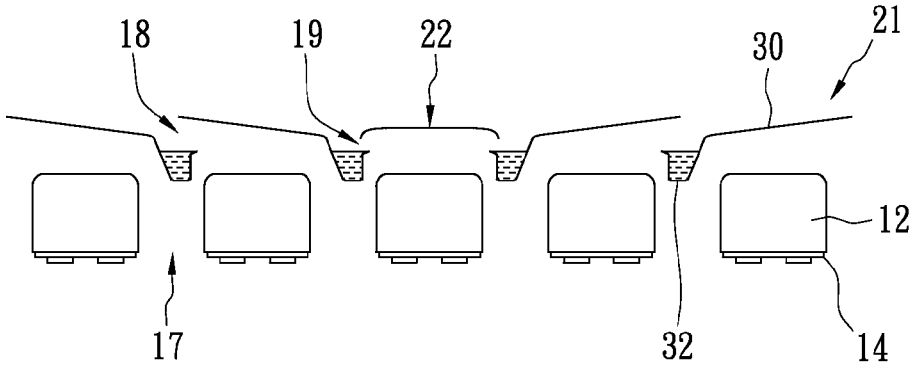

FIG. 2B is a top view of the heat-dissipating waterproof cover 20, and FIG. 2C is a side view showing the fins 12 below the illumination apparatus 11. In an embodiment, the heat-dissipating waterproof cover 20 includes a plurality of drain members 21. The drain members 21 are symmetrically disposed and correspond to cover the fins 12 of the LED modules 14. The drain member 21 includes a drain surface 30 and a groove 32. The drain surface 30 guides water such as rain into the groove 32. The drain surface 30 of the drain member 21 further extends above the groove 32 of an adjacent drain member 21, i.e., there is an overlap between two adjacent drain members 21 in vertical or the two adjacent drain members 21 are partially overlapping, so as to prevent intrusion of rain. The heat-dissipating waterproof cover 20 may further include a drain member 22 disposed above the fins 12 of the central LED module 14. The drain member 22 has no groove; instead it guides rain into the grooves 32 of the two adjacent drain members 21 at either side.

In an embodiment, a gap 17 is formed between every two adjacent LED modules 14. A gap 18 is formed between the drain surface 30 of the drain member 21 and the groove 32 of the adjacent drain member 21. A gap 19 is formed between the drain member 22 and the groove 32 of the adjacent drain member 21. In other words, the gap 18 and gap 19 are formed between the two drain members 21 or between the drain member 21 and the drain member 22, and consequently the illumination apparatus 11 is not sealed and is open to air. Accordingly, the gaps 17, 18 and 19 constitute the channels for air convection, and thus air can pass through the lamp from bottom to top, thereby increasing heat-dissipating efficiency of the fins 12.

Figure 2D:
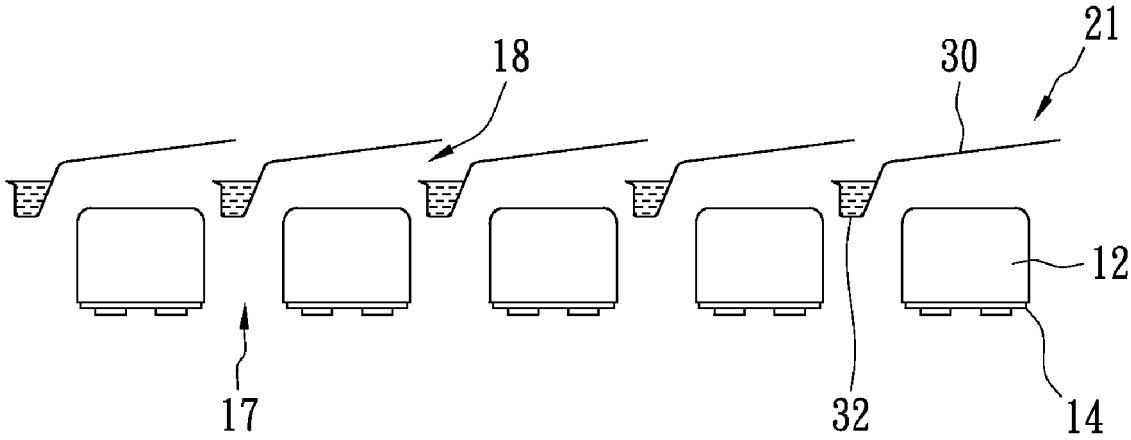
FIG. 2D illustrates a side view of an LED lamp in accordance with another embodiment of the present invention.

FIG. 2D is a side view of the LED lamp according to another embodiment of the present invention. The drain surfaces 30 of the drain members 21 direct water in the same direction. As a result, all the drain members use the same design, so as to simplify the preparation of components. In practice, according to the disclosure of the present invention, the combination of various drain members capable of providing waterproofing and air convection is also within the scope of the present invention.

Figure 3:
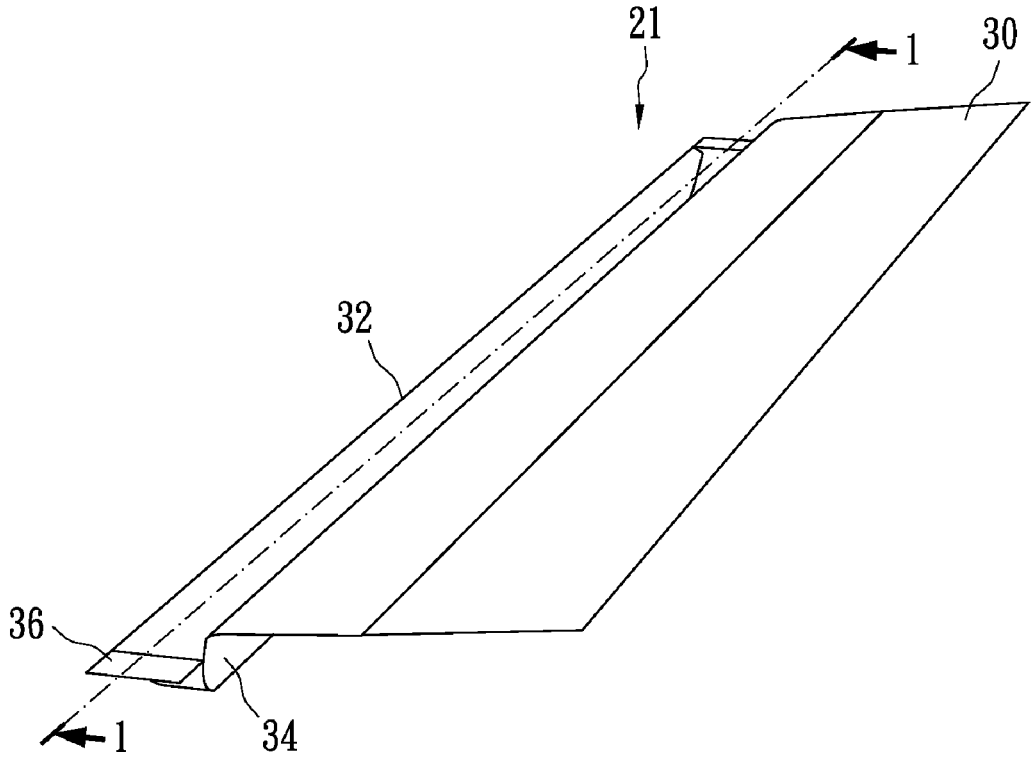
FIG. 3 illustrates a drain member of an LED lamp in accordance with an embodiment of the present invention.
Figure 4:
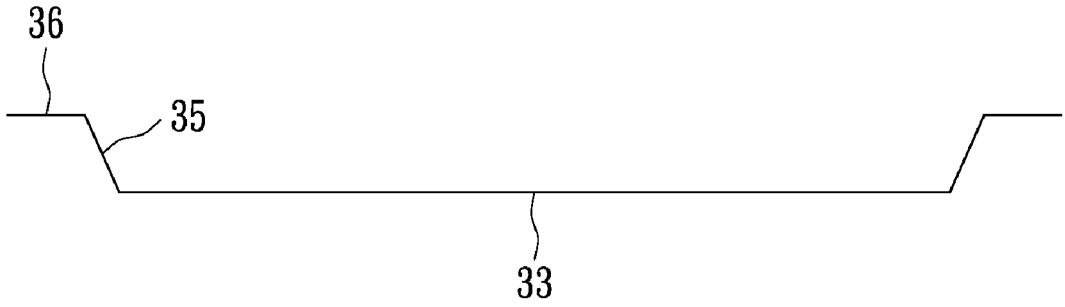
FIG. 4 illustrates a cross-sectional view along line 1-1 of FIG. 3.

FIG. 3 illustrates the details of the drain member 21, and FIG. 4 is the cross-sectional view along line 1-1 of FIG. 3. The drain member 21 includes the drain surface 30 and the groove 32. A side of the drain member 21 bends and extends downward and is connected to the groove 32. More specifically, an extension portion 34 connected to the drain surface 30 forms a sidewall of the groove 32. FIG. 4 shows that inclined surfaces 35 are formed on the groove 32 in the longitudinal direction, and each inclined surface 35 extends out of the groove 32 to form joint plates 36 to be connected to the surface of the housing 13. The angle between the inclined surface 35 and the bottom 33 of the groove 32 is between 95 and 160 degrees for accumulating rain, and draining rain when the groove is full.

Figure 5:
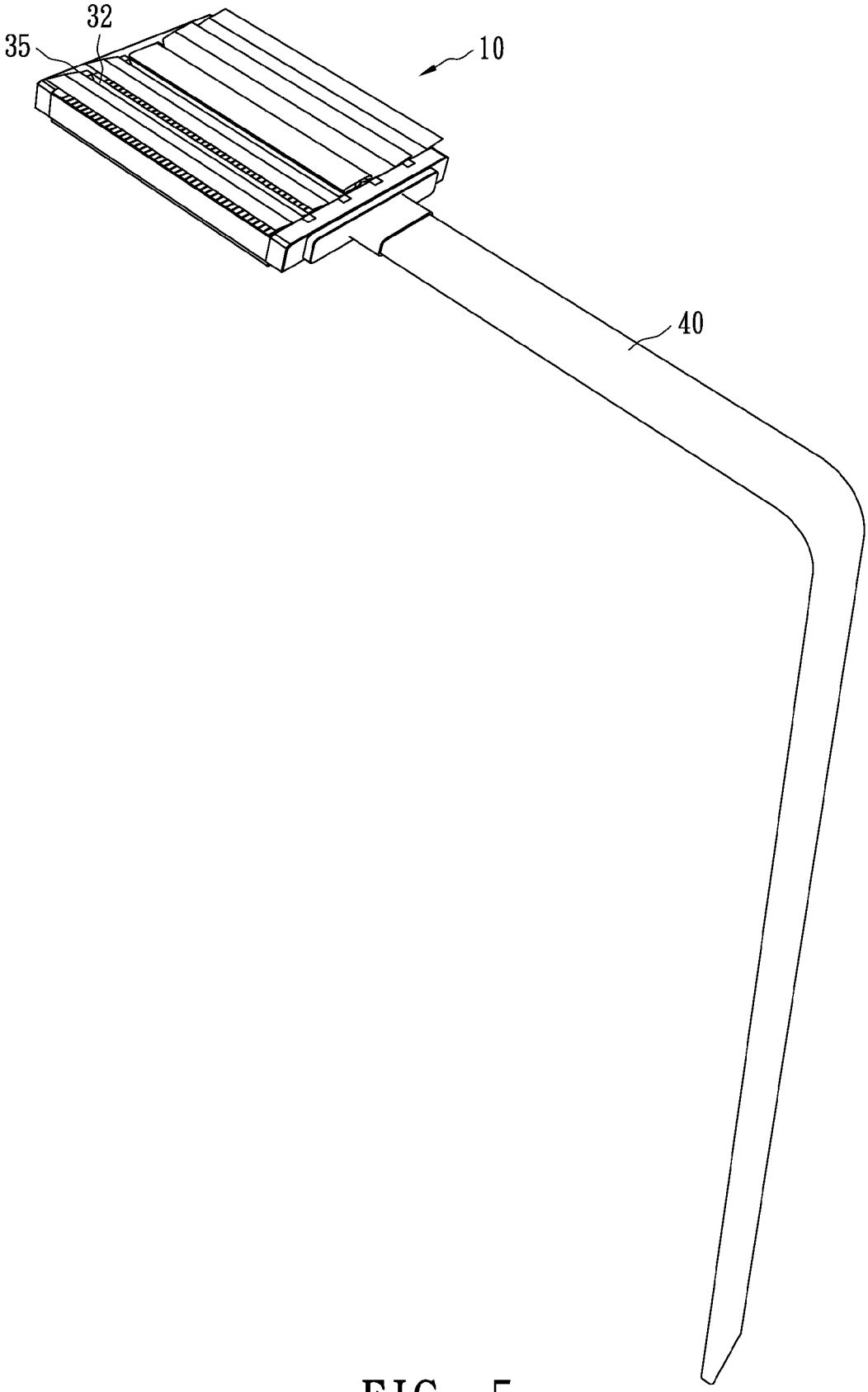
FIG. 5 illustrates an application for an LED lamp of the present invention.

FIG. 5 illustrates a streetlamp in accordance with an embodiment of the present invention. The LED lamp 10 is placed at a front end of an extension portion of the streetlamp pole 40. As a result, the LED lamp 10 is tilted, and the grooves 32 are also tilted along the longitudinal direction, thereby allowing the rain accumulated in the groove 32 to be drained through the inclined surfaces 35.

In addition to a streetlamp, the LED lamp of the present invention can be applied to illumination devices under eaves or at bus stops. In summary, as long as the LED lamp 10 is installed to be tilted, it can drain water effectively and has superior heat-dissipating efficiency.

The above-described embodiments of the present invention are intended to be illustrative only. Those skilled in the art may devise numerous alternative embodiments without departing from the scope of the following claims.

What is claimed is:

1. An LED lamp, comprising:

an illumination apparatus, comprising LED modules; and a heat-dissipating waterproof cover, comprising a plurality of first drain members, wherein the heat-dissipating waterproof cover is configured to cover the LED modules, and a first gap is formed between every two adjacent first drain members, and the two adjacent first drain members are partially overlapping in vertical.

2. The LED lamp as in claim 1, wherein the first drain member comprises a drain surface and a groove connected to a side of the drain surface.

3. The LED lamp as in claim 2, wherein the drain surface is inclined toward the groove for guiding water on the drain surface to the groove.

4. The LED lamp as in claim 2, wherein the groove comprises inclined surfaces formed at two ends of the groove along a longitudinal direction of the groove, and an angle between the inclined surface and a bottom of the groove is between 95 and 160 degrees.

5. The LED lamp as in claim 2, wherein the groove is tilted along a longitudinal direction of the groove.

6. The LED lamp as in claim 1, wherein a second gap is formed between every two adjacent LED modules, and the second gap and the first gap form air convection channels.

7. The LED lamp as in claim 1, wherein the LED module has a plurality of fins for dissipating heat from the LED module, and each of the first drain members covers the fins of the LED module.

8. The LED lamp as in claim 1, wherein the heat-dissipating waterproof cover further comprises a second drain member, and the second drain member is associated with the first drain member to cover the LED module.

9. The LED lamp as in claim 8, wherein the second drain member is disposed at the center of the heat-dissipating waterproof cover, and the first drain members are symmetrically disposed at either side of the second drain member.

10. The LED lamp as in claim 9, wherein the first drain members have drain surfaces inclining toward the second drain member.

11. The LED lamp as in claim 9, wherein the second drain member has an extension portion bending downwards and is configured to guide water on the second drain member into a groove of an adjacent first drain member.

12. The LED lamp as in claim 8, wherein the second drain member and the first drain member form a third gap.

13. The LED lamp as in claim 8, wherein the second drain member and a groove of the first drain member form a third gap.

14. A heat-dissipating waterproof cover for an LED lamp, comprising a plurality of first drain members, wherein the heat-dissipating waterproof cover is configured to cover LED modules of the LED lamp, a first gap is formed between every two adjacent first drain members, and the two adjacent first drain members are partially overlapping in vertical.

15. The heat-dissipating waterproof cover as in claim 14, wherein the first drain member comprises a drain surface and a groove connected to a side of the drain surface.

16. The heat-dissipating waterproof cover as in claim 15, wherein the drain surface is inclined toward the groove for guiding water on the drain surface to the groove.

17. The heat-dissipating waterproof cover as in claim 15, wherein the groove comprises inclined surfaces formed at two ends of the groove along a longitudinal direction of the groove, and an angle between the inclined surface and a bottom of the groove is between 95 and 160 degrees.

18. The heat-dissipating waterproof cover as in claim 14, further comprising a second drain member, the second drain member is associated with the first drain member to cover the LED modules, the second drain member is disposed at the center of the heat-dissipating waterproof cover, and the first drain members are symmetrically disposed at either side of the second drain member.

19. The heat-dissipating waterproof cover as in claim 18, wherein the first drain members have drain surfaces inclining toward the second drain member.

20. The heat-dissipating waterproof cover as in claim 18, wherein the second drain member has an extension portion bending downwards and is configured to guide water on the second drain member into a groove of an adjacent first drain member.

* * * * *